United States Patent [19]

Nocivelli

[11] Patent Number: 4,563,230

[45] Date of Patent: Jan. 7, 1986

[54] METHOD OF MAKING DOUBLE LAYER SHEET METAL PANELS WITH DUCTS FORMED BY INFLATION

[75] Inventor: Luigi Nocivelli, Verolanuova, Italy

[73] Assignee: C.G.A. Compagnia Generale Alluminio S.p.A., Cividale del Friuli, Italy

[21] Appl. No.: 623,349

[22] Filed: Jun. 22, 1984

[30] Foreign Application Priority Data

Jun. 24, 1983 [IT] Italy ..... 21785 A/83

[51] Int. Cl.[4] ..... B29C 65/00

[52] U.S. Cl. ..... 156/80; 72/54; 72/58; 72/61; 156/289

[58] Field of Search ..... 156/80, 156, 289; 72/58, 61, 63, 54

[56] References Cited

U.S. PATENT DOCUMENTS

| | | | |
|---|---|---|---|
| 655,838 | 8/1900 | Tesla | 156/80 |
| 2,895,172 | 7/1959 | Meissner | 156/80 |
| 3,021,888 | 2/1962 | Marinovich et al. | 72/58 |
| 3,094,956 | 6/1963 | Pauls | 72/58 |
| 3,187,533 | 6/1965 | Cave | 72/61 |
| 4,126,659 | 11/1978 | Blad | 156/80 |

*Primary Examiner*—Caleb Weston

*Attorney, Agent, or Firm*—Fleit, Jacobson, Cohn & Price

[57] ABSTRACT

A method of making sheet metal panels from two layers between which ducts are formed by inflation, in which the inflation is effected by the use of a predetermined quantity of Freon in the liquid state, the subsequent evacuation of the Freon from the ducts being effected by evaporation.

5 Claims, 2 Drawing Figures

METHOD OF MAKING DOUBLE LAYER SHEET METAL PANELS WITH DUCTS FORMED BY INFLATION

The present invention relates to a method of making sheet metal panels from two layers between which ducts are formed, that is panels known commercially as "roll bond" panels, and used in the art as heat exchangers, for example as evaporators in refrigerator circuits, solar panels and the like.

A known method of making roll bond panels comprises the successive stages of:

spreading an anti-welding material on one layer in correspondence with the ducts to be formed, bonding together the two superimposed layers by rolling, providing a prefixed quantity of a liquid, inflating the ducts by introducing the said quantity of liquid, and evacuating the ducts thus inflated.

In order to carry out the stage of inflating the ducts, according to a known method, water or oil are used as the inflating fluid. The most significant disadvantage of such a method lies in the need to empty the ducts of the liquid introduced, and then to carry out a long and onerous drying cycle, rendered the more difficult by the complex design of the ducts.

It has also been suggested to use air as the inflating fluid, to eliminate the inconvenience caused by the removal of the liquid from the ducts. This method, while allowing the drying stage to be eliminated, nevertheless presents a serious difficulty due to the fact that it does not permit the achievement of an internal volume of the ducts with sufficiently narrow tolerance, by virtue of the high compressibility of air.

The problem which is at the heart of the present invention is that of providing a method of the type specified which has characteristics such as to overcome all the disadvantages cited with reference to the known methods.

This problem is resolved according to the invention by a method of the type specified, which is characterised in that the inflation stage is effected with a liquid which is gaseous at ambient temperature and pressure, and in that the evacuation stage is effected by evaporation of the said liquid to the gaseous state.

To advantage the said liquid is chosen from refrigerant fluids.

Figure 1:
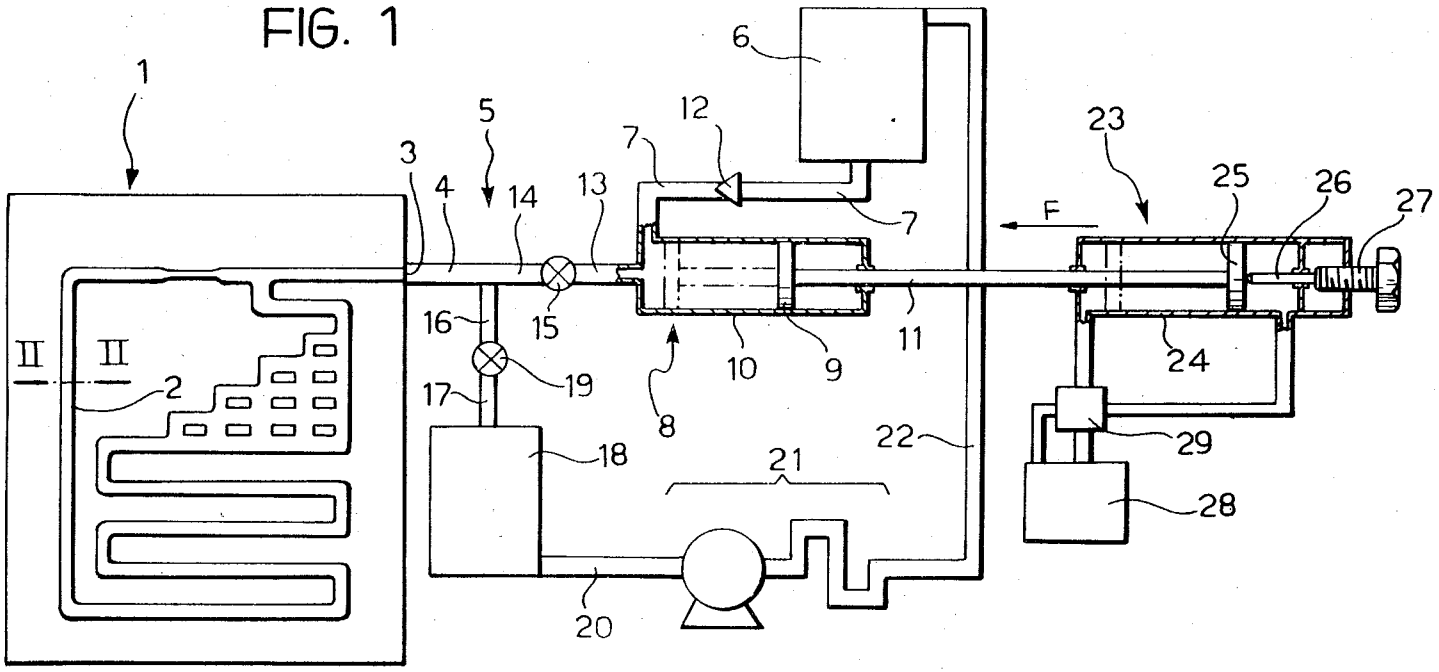
Figure 2:
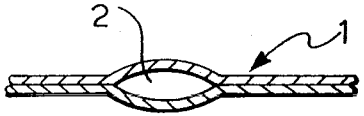

Further characteristics and advantages of the invention will become much clearer from the following detailed description of one example of a method according to the invention, with reference to the accompanying drawings, given solely by way of non-limiting example, in which:

FIG. 1 represents schematically a plant for carrying out a method for obtaining ducts by means of inflation of panels according to the invention, and FIG. 2 shows a section on an enlarged scale of a duct of the panel of FIG. 1.

With reference to the said drawings, reference numeral 1 indicates generally a panel made by the method according to the invention.

The panel 1 is formed internally with ducts, indicated generally by 2, communicating with the outside through an aperture 3. A line 4 is releasably connected to the said aperture 3, and is connected to a plant for carrying out a method according to the invention, indicated generally by 5. This plant 5 includes a storage tank 6 for a liquid which is gaseous at ambient temperature and pressure. In the illustrated example this liquid is a refrigerant fluid, having the chemical formula $CF_2Cl_2$, commercially known by the name "Freon 12"

It should be noted that other types of fluid may also be used, for example "Freon 11", "Freon 13", "Freon 21", "Freon 22""Freon 23", "Freon 114", "Freon 115", "Freon 133", "Freon 142", "Freon 143", and the like.

The said tank 6 is connected through a line 7 to a metering device, constituted by a cylinder-piston unit 8, having a piston 9 which is axially and sealingly slidable in a cylindrical housing 10, and which is fixed to a rod 11.

A non-return valve 12 is inserted in the line 7 and allows flow of the liquid from the tank 6 to the metering unit 8, but not in the opposite direction. The said metering unit 8 is connected to the aperture 3 through the line 4 and lines 13 and 14 in series. Between the lines 13 and 14 there is inserted an shut-off valve 15.

Reference numerals 16 and 17 indicate lines in series which connect the line 4, and thus the aperture 3, with a tank 18 for collecting the "Freon 12" in the vapour state. Between the lines 16 and 17 there is inserted a shut-off valve 19.

The tank 18 is connected through a line 20 to a compressor-condenser unit 21, and thence, by means of a line 22 to the tank 6.

Reference numeral 23 indicates a cylinder-piston unit comprising a cylindrical housing 24 and a piston 25 axially and sealingly slidable within the housing 24. The piston 25 is fixed to the rod 11 and is thus connected operatively to the piston 9 of the metering unit 8. Reference numeral 26 indicates an end-of-stroke device for the piston 25, adjustable by means of a screw 27. The cylindrical housing 24 is, moreover, in communication with a hydraulic control unit 28 through a solenoid changeover valve 29.

The operation of the plant 5, which carries out the method of this invention, is as follows.

With reference to an initial condition which is represented in the drawings by continuous lines, the piston 25 is made to slide, under control of the control unit 28, in the direction of the arrow F, until the piston 25 reaches the position indicated in broken outline. During this stage the valve 19 is closed and the valve 15 is open.

The movement of the piston 25 causes the displacement of the piston 9, consequently creating a pressure, between 140 and 200 atmospheres, in the "Freon 12" liquid contained in the cylinder 8 which, in consequence, is forced through the lines 13, 14 and 4 and the valve 15, towards the aperture 3 and is thus introduced into the ducts 2, thereby effecting the inflation.

The evacuation of the ducts 2 is subsequently carried out by putting the said ducts 2 into communication with the tank 18, which is maintained at a pressure significantly lower than the inflation pressure, for example between 0.2 and 2 atmospheres absolute. This operation is carried out by opening the valve 19 and closing the valve 15. The "Freon 12" contained in the ducts 2, in consequence, evaporates and fills the collection tank 18. The pressure of this tank 18 is maintained at the said low value by means of the compressor-condenser unit 21 which effects liquefaction of the "Freon 12" and delivers it into the storage tank 6 for use in a subsequent inflation cycle.

For this purpose, after substitution of the finished panel by another to be subjected to inflation of its ducts, a predetermined quantity of "Freon 12" is withdrawn from the storage tank 6 and passed into the cylinder 8. This operation is carried out under control of the hydraulic control unit 28 which acts on the piston 25, causing it to slide from the position shown in broken outline to return to its initial position.

It should be noted that if it is necessary to adjust the quantity of "Freon 12" to be introduced into the ducts 2, it suffices to adjust the screw 27 which determines the position of the stroke limit device 26 and thus the length of the stroke of the piston 25 and of the piston 9. The movement of the piston 25 causes the displacement of the piston 9, with consequent creation of a low pressure within the cylinder 8. As a result of this low pressure the "Freon 12" contained in the tank 6 is drawn into the cylinder 8, in a quantity determined by the length of the stroke of the piston 9 and is ready to be used in a further inflation stage according to the operation previously described.

The principal advantage resulting from the method according to the invention resides in its rapidity and efficiency. In fact, by virtue of the high volatility of the chosen liquid, complete evaporation occurs in the evacuation stage without the necessity to subject the panel to a drying cycle. Moreover, the ducts are formed with accurately repeated dimensions, so that the method maintains the advantages typical of the use of a liquid in the inflation stage.

I claim:

1. A method of making sheet metal panels of two layers between which ducts are formed, comprising the successive steps of:

spreading an anti-welding material on one layer in correspondence with the ducts to be formed, bonding the two superimposed layers together by rolling, providing a predetermined quantity of liquid, inflating the ducts by introducing the said quantity of liquid between the layers and evacuating the ducts after inflation thereof, wherein the said inflating step is effected by means of a liquid which is gaseous at ambient temperature and pressure, and wherein the said evacuating step is effected by evaporation of the said liquid to the gaseous state.

2. The method defined in claim 1, wherein the said liquid is chosen from refrigerant fluids.

3. The method defined in claim 1, wherein the said step of providing a predetermined quantity of liquid is effected by means of a metering cylinder-piston unit operated by drive means.

4. The method defined in claim 3, wherein the drive means for the cylinder piston unit include a hydraulic cylinder-piston unit.

5. The method defined in claim 1, wherein the said evacuating step is effected by means of a compressor-condenser unit.

* * * * *